US010626871B2

(12) United States Patent
Gieras et al.

(10) Patent No.: US 10,626,871 B2
(45) Date of Patent: Apr. 21, 2020

(54) CENTRIFUGAL PUMP WITH INTEGRATED AXIAL FLUX PERMANENT MAGNET MOTOR

(71) Applicant: Hamilton Sundstrand Corporation, Charlotte, NC (US)

(72) Inventors: Jacek F. Gieras, Glastonbury, CT (US); Gregory I. Rozman, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 612 days.

(21) Appl. No.: 14/962,244

(22) Filed: Dec. 8, 2015

(65) Prior Publication Data

US 2017/0159661 A1 Jun. 8, 2017

(51) Int. Cl.

| | |
|---|---|
| ***F04D 13/06*** | (2006.01) |
| ***F04D 1/02*** | (2006.01) |
| ***F04D 29/24*** | (2006.01) |

(52) U.S. Cl.

CPC ..... *F04D 13/06* (2013.01); *F04D 1/02* (2013.01); *F04D 13/0666* (2013.01); *F04D 29/24* (2013.01); *F05B 2260/404* (2013.01); *F05B 2280/1071* (2013.01); *F05B 2280/5008* (2013.01)

(58) Field of Classification Search

CPC ..... F04D 13/0646; F04D 13/0666; F04D 29/048; F04D 29/146

See application file for complete search history.

(56) References Cited

U.S. PATENT DOCUMENTS

| | | | | |
|---|---|---|---|---|
| 2,484,554 A | | 10/1949 | Concordia et al. | |
| 3,068,801 A | | 12/1962 | Murray | |
| 3,194,165 A | | 7/1965 | Sorlin | |
| 3,689,787 A | | 9/1972 | Saretzky | |
| 3,867,655 A | * | 2/1975 | Stengel | F01D 15/10 290/43 |
| 3,932,069 A | | 1/1976 | Giardini et al. | |
| 4,959,578 A | | 9/1990 | Varga | |
| 5,156,522 A | | 10/1992 | Tessier | |
| 5,607,329 A | * | 3/1997 | Cho | B63H 1/16 310/266 |
| 6,227,817 B1 | * | 5/2001 | Paden | F04D 13/0646 417/356 |

(Continued)

FOREIGN PATENT DOCUMENTS

| | | |
|---|---|---|
| FR | 1274546 A | 10/1961 |
| GB | 1569842 A | 6/1980 |

OTHER PUBLICATIONS

Extended European Search Report for EP Application No. 16201305.6, dated Apr. 6, 2017, 8 pages.

*Primary Examiner* — Patrick Hamo

(74) *Attorney, Agent, or Firm* — Kinney & Lange, P.A.

(57) ABSTRACT

A pump system comprises a fluid housing, a permanent magnet rotor, and an electric stator. The fluid housing has an axis, an axial inlet, and a radially outer outlet. The permanent magnet rotor is disposed on the axis, within the fluid housing, and has a plurality of perimetrically distributed fins that extend at least partly radially outward. The electric stator is disposed on the axis and within the fluid housing, and is situated adjacent the impeller fins of the permanent magnet rotor, separated from the impeller fins by an axial gap.

13 Claims, 4 Drawing Sheets

(56) References Cited

U.S. PATENT DOCUMENTS

| | | | | |
|---|---|---|---|---|
| 7,061,152 | B2 * | 6/2006 | Petro | H02K 21/14<br>310/156.38 |
| 9,325,217 | B2 * | 4/2016 | Veltri | F16C 32/0417 |
| 9,391,500 | B2 * | 7/2016 | Smith | H02K 1/182 |
| 2011/0248593 | A1 | 10/2011 | Fiorenza | |

* cited by examiner

CENTRIFUGAL PUMP WITH INTEGRATED AXIAL FLUX PERMANENT MAGNET MOTOR

BACKGROUND

The present invention relates generally to motor-driven pumps, and more particularly to a centrifugal pump integrated with an axial-flux motor.

Centrifugal pumps are used in a variety of fluid handling applications. Centrifugal pumps typically include a rotary impeller with a plurality of vanes or paddles that force fluid centrifugally outward and in a flow direction. Centrifugal pump impellers are ordinarily driven by a motor, either directly or via an attached gearbox. Directly driven centrifugal pumps most commonly include one or more axially in-line motors adjacent the pump, connected to the impeller via an intervening axial driveshaft. In some cases, one motor may drive other devices than the pump, necessitating a gearbox or a shared driveshaft. The motor and pump form a combined system that is often large and heavy, and includes many moving parts.

SUMMARY

In one aspect, the present invention is directed toward a pump system comprising a fluid housing, a permanent magnet rotor, and an electric stator. The fluid housing has an axis, an axial inlet, and a radially outer outlet. The permanent magnet rotor is disposed on the axis, within the fluid housing, and has a plurality of perimetrically distributed fins that extend at least partly radially outward. The electric stator is disposed on the axis and within the fluid housing, and is situated adjacent the impeller fins of the permanent magnet rotor, separated from the impeller fins by an axial gap.

In another aspect, the present invention is directed toward a method of pumping fluid by energizing field poles of a stator with alternating current, and driving a permanent magnet rotor via axial flux impingement from the energized stator on at least partially radially extending ferromagnetic fluid impeller fins. The stator is situated in an axial fluid path of a centrifugal pump housing. When energized, the ferromagnetic fluid impeller fins draw fluid axially through apertures in the stator, and forces fluid centrifugally outward and in a flow direction.

The present summary is provided only by way of example, and not limitation. Other aspects of the present disclosure will be appreciated in view of the entirety of the present disclosure, including the entire text, claims, and accompanying figures.

Figure 1:
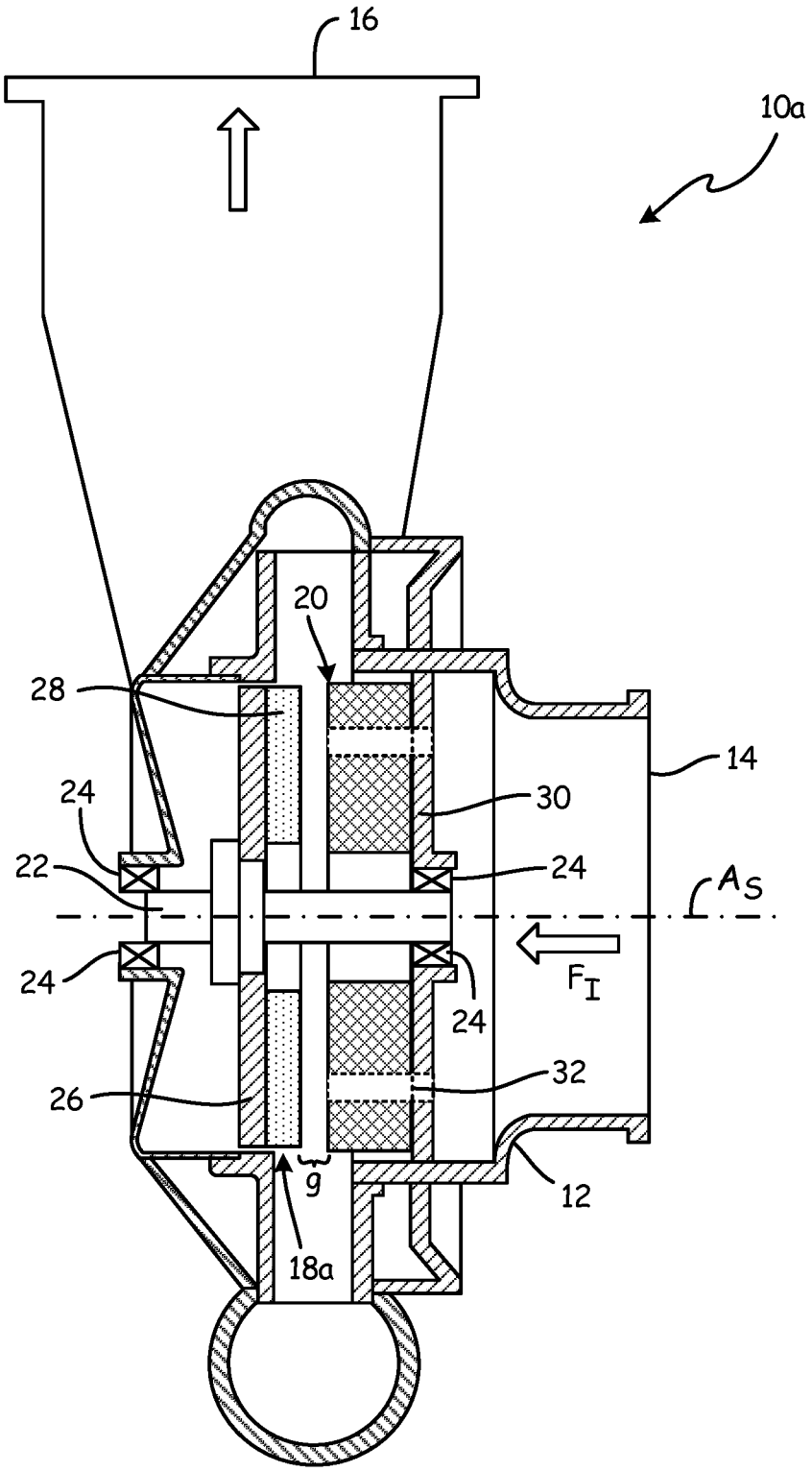
FIG. 1 is a simplified cross-sectional view of an embodiment of a pump system including a centrifugal pump with an integrated axial flux permanent magnet motor.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The present disclosure concerns a centrifugal pump with an integrated axial flux permanent magnet motor. Impeller fins of the pump double either as permanent magnets of the motor, or as ferromagnetic pole shoes affixed to perimetrically distributed magnetic sections on a backing disk. The pump and motor share a common housing and bearing assembly, allowing compact and lightweight construction of the combined structure, with fewer moving parts. Axial gap motor geometry allows for high power density and easy integration between pump and motor.

FIG. 1 is a simplified cross-sectional view of pump system 10*a*, which is one embodiment of a combined permanent magnet motor and centrifugal fluid pump system. Pump system 10*a* comprises housing 12 with inlet 14 and outlet 16, rotor 18*a*, stator assembly 20, shaft 22 along shaft axis $A_s$, bearings 24, rotor backing disk 26, permanent magnet impeller fins 28, stator backing disk 30, and stator inlet passage 32.

Housing 12 contains and supports all other components of pump system 10*a*, and defines a fluid flow path from inlet flow $F_1$ substantially aligned with shaft axis $A_s$ at inlet 14 to a substantially tangential and radially outward outlet flow $F_O$ at outlet 16. Housing 12 can be constructed of any rigid, load-bearing material, such as structural steel or aluminum. In alternative embodiments, housing 12 can be formed of a fiberglass or polymer material. Shaft 22 is disposed within housing 12 along shaft axis $A_s$, and is rotatably supported on bearings 24. Bearings 24 can, for example, be ball or roller bearings. Rotor 18*a* is supported by rotor backing disk 26, which is a rotating rigid ferromagnetic support structure that extends radially outward from shaft 22. Stator backing disk 30 is similarly a stationary rigid ferromagnetic support structure that supports stator assembly 20, and is anchored to housing 12. In at least some embodiments, rotor backing disk 26 and/or stator backing disk 30 are formed of steel. In the depicted embodiment, stator backing disk 30 supports a front race of bearings 24 proximal to inlet 14, while housing 12 directly supports a rear race of axially distal bearings 24. A plurality of perimetrically distributed stator passages 32 extend through stator assembly 20 and stator backing disk 30, as described in greater detail with respect to FIG. 3, below.

Rotor 18*a* is a rotating assembly including a plurality of perimetrically distributed, swept and/or angled permanent magnet impeller fins 28 that extend at least partially radially outward from shaft 22. When rotor 18*a* rotates, permanent magnet impeller fins 28 centrifugally force fluid radially outward towards outlet 16, drawing in fluid axially through stator passages 32 toward a resulting low-pressure region surrounding shaft 22. At least a portion of each permanent magnet impeller fin 28 is formed of a magnetic material such as SmCo, NdFeB, or other permanent magnet materials. In some embodiments, the entirety of each permanent magnet impeller fin 28 is formed of magnetic material. Rotor 18*a* includes an even number of permanent magnet impeller fins 28, and each permanent magnet impeller fin 28 is perimetrically adjacent to magnets of opposite magnetic polarity.

During operation of pump system 10*a*, stator assembly 20 is energized with alternating current, generating a changing magnetic field at permanent magnet impeller fins 28 across axial gap g. Stator assembly 20 can, for instance, receive alternating current from an external power source or a conditioned onboard energy storage device (not shown). Magnetic flux created by stator assembly 20 drives rotor 18*a*, causing rotor backing disk 26 and permanent magnet impeller fins 28 to rotate about shaft axis $A_s$. Fluid enters housing 12 as substantially axial inlet flow $F_1$ through inlet 14. Inlet flow $F_1$ impinges on stator backing disk 30, and is drawn axially through stator passages 32 by rotation of rotor 18*a*. Fluid between stator assembly 20 and rotor 18*a* is driven centrifugally (i.e. radially and tangentially) outward towards outlet 16, creating suction that draws further fluid from inlet 14 through stator passages 32.

Pump system 10*a* provides a compact centrifugal pump assembly with an integrated axial-flux motor. Pump system 10*a* consequently obviates any need for a separate motor and/or driveshaft, reducing total system weight, complexity, and size.

Figure 2:
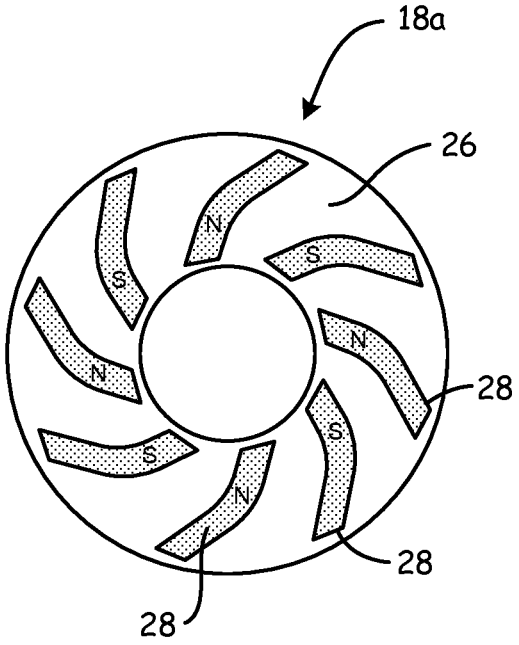
FIG. 2 is a side view of a rotor of the pump system of FIG. 1.

FIG. 2 is a schematic side view of rotor 18*a* of the pump system 10*a*, and illustrates shaft 24, rotor backing disk 26, and permanent magnet impeller fins 28. As described above with respect to FIG. 1, rotor backing disk 26 rides shaft 22, and permanent rotor fins 28 are affixed to rotor backing disk 26. Permanent magnet rotor fins 28 can, for example, be attached to rotor backing disk 26 via pins, bolts, or screws. Rotor 18*a* rotates under electromagnetic torque applied via permanent magnet impeller fins 28 when stator assembly 20 is energized. Rotor backing disk 26 is formed of a ferromagnetic material such as steel. As noted above, permanent magnet impeller fins 28 are formed partially or entirely of a permanent magnetic material such as SmCo, NdFeB, or other permanent magnet materials. Rotor 18*a* includes an even number of permanent magnet impeller fins 28 (eight, in the illustrated embodiment), which are angled or swept in a flow direction, and evenly perimetrically distributed about shaft axis $A_s$. Permanent magnet impeller fins 28 serve both as fins of a circumferential pump impeller, and as poles (vanes) of an axial-flux permanent magnet motor. Each permanent magnet impeller fin 28 has magnetic polarization substantially equal in magnitude and opposite in orientation to closest circumferential neighbors.

Figure 3:
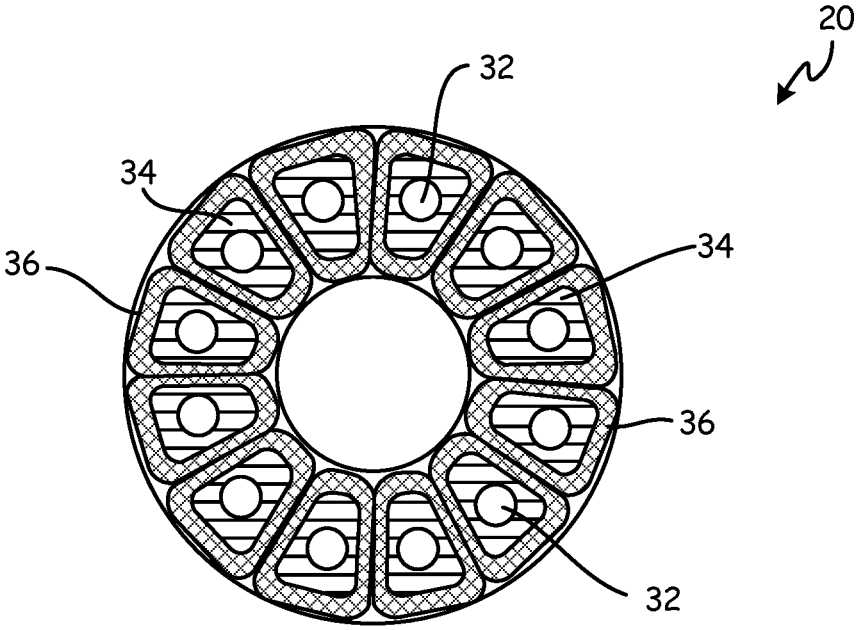
FIG. 3 is a side view of a stator of the pump system of FIG. 1.

FIG. 3 is a side view of stator assembly 20 of the pump system 10*a*, illustrating stator passages 32, stator cores 34, and stator windings 36. Stator cores 34 are rigid ferromagnetic blocks affixed to stator backing disk 30 (see FIG. 1), e.g. via bolts, pins, screws, and/or adhesive. Each stator core 34 is surrounded by stator windings 36 of conductive material. Stator windings 36 are energized with alternating current to drive rotor 18*a*. Stator windings 36 can, for example, be formed of wire wound about stator cores 34, or of additively manufactured winding structures formed integrally atop stator cores 34.

Stator assembly 20 comprises an even number of distinct poles each formed of a stator core 34 surrounded by windings 36. In general, where $N_c$ is the number of stator cores (poles) equal to the number of coils:

$$N_c = kmGCD(N_c, B) \quad \text{[Equation 1]}$$

where m is the number of stator phases, B is the number of permanent magnet impeller fins 28, GCD($N_c$, B) is the greatest common divisor of $N_c$ and B, and where k is a positive integer. Thus, once an even number B of permanent magnet impeller fins 28 is selected based on desired pumping behavior, the number $N_c$ of stator cores is correspondingly partially determined.

Stator passages 32 pass entirely axially through stator cores 34, and allow suction from rotor 18*a* to carry fluid from inlet 14 to rotor 18*a* (see FIG. 1). In some embodiments, each stator core 34 is disposed with a corresponding stator passage 32. In other embodiments, only some stator cores 34 have stator passages 32. Stator passages 32 can be evenly perimetrically distributed about shaft axis $A_s$, either by providing each stator core 34 with a stator passage 32, or by selecting stator cores 34 for stator passages 32 in a perimetrically balanced fashion. Although stator passages 32 are illustrated as circular in cross-section, any cross-section is possible. Generally, the shape, number, and distribution of stator passages 32 can be selected to minimize pressure losses of fluid passing through stator passages 32 to rotor 18*a*. To protect against exposure to fluid pumped by pump system 10*a*, stator assembly 20 can be surrounded by a fluid sealing layer or laminate.

Figure 4:
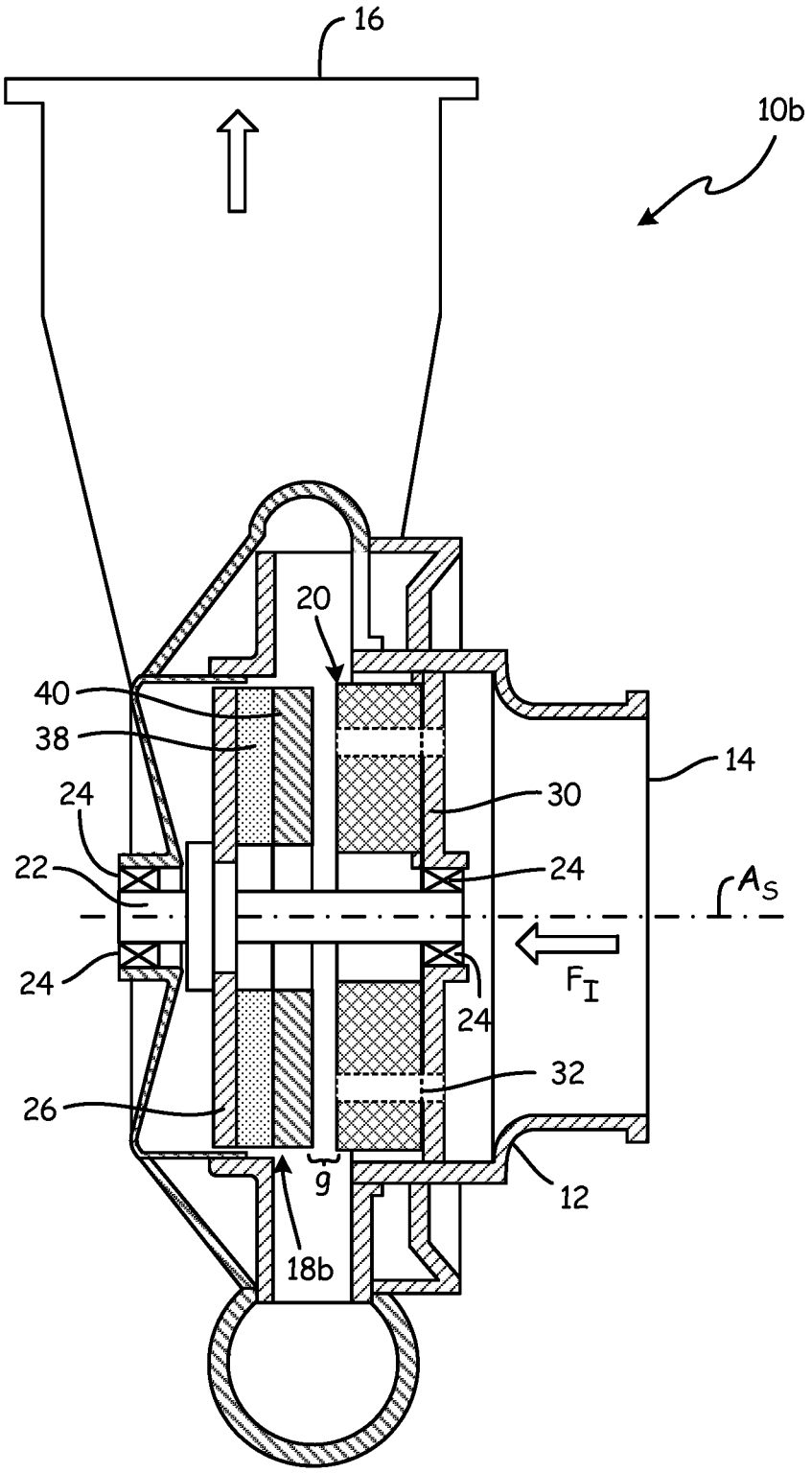
FIG. 4 is a simplified cross-sectional view of another embodiment of a pump system including a centrifugal pump with an integrated axial flux permanent magnet motor
Figure 5:
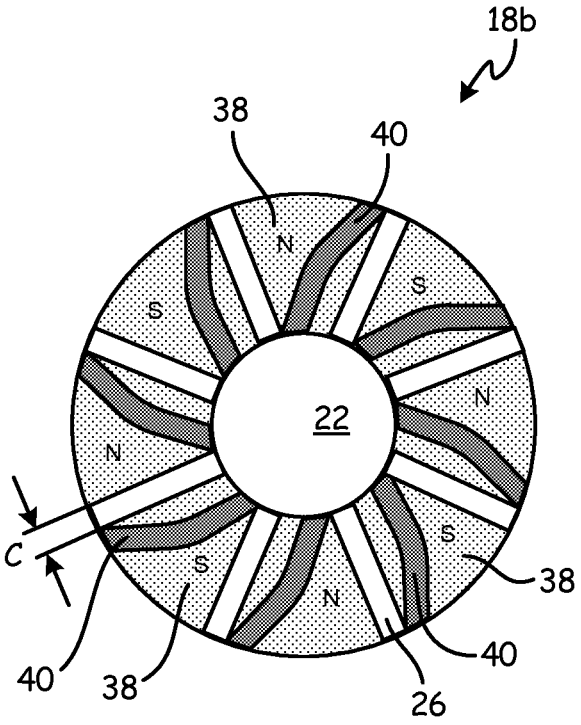
FIG. 5 is a side view of a rotor of the pump system of FIG. 4.

FIGS. 4 and 5 illustrate aspects of pump system 10*b*, which is an alternative embodiment to pump system 10*a*. FIG. 4 is a simplified cross-sectional view of pump system 10*b* paralleling FIG. 1, and illustrates housing 12 (with inlet 14 and outlet 16), stator assembly 20, shaft 22 along shaft axis $A_s$, bearings 24, rotor backing disk 26, stator backing disk 30, and stator inlet passage 32, as described above with respect to FIG. 1. FIG. 4 further illustrates rotor 18*b* in place of rotor 18*a* of pump system 10*a*. Rotor 18*b* operates similarly to rotor 18*a*, but includes permanent magnet sections 38 and pole shoe impeller fins 40 instead of permanent magnet impeller fins 28. FIG. 4 is a schematic side view of rotor 18*b* paralleling FIG. 2, above.

Pump system 10*b* and rotor 18*b* operate substantially similarly to pump system 10*a* and rotor 18*a*, save that rotor 18*b* has no permanent magnet impeller fins 28. Instead, a plurality of trapezoidal or truncated arcuate permanent magnet sections 38 are affixed to rotor backing plate 26, e.g. via screws and/or adhesive. Permanent magnet sections 38 can be uncontoured, flat plates of magnetic material such as SmCo and/or NdFeB, with the number and polarization of permanent magnet sections 38 matching permanent magnet impeller fins 28, described above. Permanent magnet sections 38 do not primarily serve as impeller fins. Instead, pole shoe impeller fins 40 are affixed directly to permanent magnet sections 38, and extend axially therefrom towards gap g. Pole shoe impeller fins 40 are formed of a ferromagnetic material such as steel, and serve both as fluid impeller elements and as a flux paths for magnetic flux between stator assembly 20 and permanent magnet sections 38 of rotor 18*b*. Pole shoe impeller fins 40 can, for example, be secured in immediate contact with permanent magnet sections 38 via pins, screws, or other fasteners that attach to permanent magnet sections 38, or that extend through permanent magnet sections 38 into rotor backing plate 26. In the embodiment illustrated in FIG. 5, each permanent magnet section 38 is separated from adjacent permanent magnet sections 38 by a circumferential gap c. This gap can be filled with non-ferromagnetic material.

Pump systems 10*a* and 10*b* provide a compact, efficient motor arrangement integral with pumping apparatus, thereby obviating any need for a separate motor, driveshaft, or gearbox to drive rotors 18*a* and 18*b*.

Discussion of Possible Embodiments

The following are non-exclusive descriptions of possible embodiments of the present invention.

A pump system comprising: a fluid housing with an axis, an axial inlet, and a radially outer outlet; a permanent magnet rotor disposed on the axis, within the fluid housing, and having a plurality of perimetrically distributed impeller fins that extend at least partially radially outward; and an electric stator disposed on the axis, within the fluid housing, adjacent the impeller fins of the permanent magnet rotor, and separated from the impeller fins by an axial gap.

The pump system of the preceding paragraph can optionally include, additionally and/or alternatively, any one or more of the following features, configurations and/or additional components:

A further embodiment of the foregoing pump system, wherein the permanent magnet rotor comprises a radially extending ferromagnetic backing disk that supports the impeller fins.

A further embodiment of the foregoing pump system, wherein the ferromagnetic backing disk is formed of steel.

A further embodiment of the foregoing pump system, wherein each of the impeller fins comprises a permanent magnet.

A further embodiment of the foregoing pump system, wherein perimetrically adjacent impeller fins comprise permanent magnets of opposite polarity.

A further embodiment of the foregoing pump system, wherein the permanent magnet is formed of a material selected from the group consisting of SmCo and NdFeB.

A further embodiment of the foregoing pump system, wherein the entirety of each impeller is formed of a permanent magnet material.

A further embodiment of the foregoing pump system, wherein the permanent magnet rotor further comprises a plurality of perimetrically distributed permanent magnet sections of alternating polarity, disposed axially between the backing disk and the impeller fins.

A further embodiment of the foregoing pump system, wherein the impeller fins are ferromagnetic pole shoes that directly each abut a single permanent magnet section.

A further embodiment of the foregoing pump system, wherein each permanent magnet section comprises an arcuate or trapezoidal permanent magnet not abutting any adjacent permanent magnet section.

A further embodiment of the foregoing pump system, wherein the electric stator is surrounded by a fluid-sealing laminate.

A further embodiment of the foregoing pump system, wherein the electric stator includes a plurality of axially-oriented stator passages disposed to carry fluid from the axial inlet to the permanent magnet rotor.

A further embodiment of the foregoing pump system, wherein the electric stator comprises a plurality of perimetrically distributed poles, each having a ferromagnetic core surrounding by a plurality of windings.

A further embodiment of the foregoing pump system, wherein the perimetrically an axially-oriented stator passage is disposed through at least some of the ferromagnetic cores.

A further embodiment of the foregoing pump system, wherein the axially-oriented stator passages are evenly perimetrically distributed about the axis.

A further embodiment of the foregoing pump system, wherein: the stator has a number m of phases; the plurality of impeller fins includes an even number B of impeller fins; and the plurality of perimetrically distributed poles includes a number $N_c$ of poles (coils), such that $N_c$ is an integer multiple of m times the greatest common divisor of $N_c$ and B.

A method of pumping fluid, the method comprising: energizing field poles of a stator situated in an axial fluid path of a centrifugal pump housing with alternating current; and driving a permanent magnet rotor via axial flux impingement from the energized stator on at least partially radially extending ferromagnetic fluid impeller fins, such that the fluid is: drawn axially through apertures in the stator; and forced centrifugally outward and in a radial flow direction by the ferromagnetic fluid impeller fins.

The method of the preceding paragraph can optionally include, additionally and/or alternatively, any one or more of the following features, configurations and/or additional components:

A further embodiment of the foregoing method, wherein the permanent magnet rotor is driven via flux impingement on permanent magnets that form the fluid impeller fins.

A further embodiment of the foregoing method, wherein the permanent magnet rotor is driven via flux impingement on pole shoes that form the fluid impeller fins, and extend from perimetrically distributed, alternating permanent magnet poles.

A further embodiment of the foregoing method, wherein the apertures in the stator are perimetrically distributed apertures through ferromagnetic cores of the field poles of the stator.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump system comprising:

a fluid housing with an axis, an axial inlet, and a radially outer outlet;

a permanent magnet rotor disposed on the axis, within the fluid housing, the permanent magnet rotor comprising:

a rotor backing disk;

a plurality of truncated arcuate permanent magnet sections affixed to the backing plate, each of the plurality of permanent magnet sections circumferentially spaced apart from an adjacent permanent magnet section by a gap; and a ferromagnetic pole shoe impeller fin abutting each of the plurality of permanent magnet sections; and an electric stator disposed on the axis, within the fluid housing, adjacent the axial inlet and the pole shoe impeller fins of the permanent magnet rotor, and separated from the pole shoe impeller fins by an axial gap, such that each pole shoe impeller fin extends axially from each of the plurality of permanent magnet sections toward the electric stator.

2. The pump system of claim 1, wherein the rotor backing disk comprises a ferromagnetic material.

3. The pump system of claim 2, wherein the ferromagnetic rotor backing disk is formed of steel.

4. The pump system of claim 1, wherein the plurality of permanent magnet sections are formed of a material selected from the group consisting of SmCo and NdFeB.

5. The pump system of claim 1, wherein the plurality of permanent magnet sections are disposed axially between the rotor backing disk and the impeller fins.

6. The pump system of claim 1, wherein the electric stator is surrounded by a fluid-sealing laminate.

7. The pump system of claim 1, wherein the electric stator includes at least one axially-oriented stator passage disposed to allow passage of fluid from the axial inlet to the axial gap.

8. The pump system of claim 1, wherein the electric stator comprises a plurality of perimetrically distributed poles, each having a ferromagnetic core surrounded by a plurality of windings.

9. The pump system of claim 7, wherein the at least one axially-oriented stator passage is disposed through at least one ferromagnetic core.

10. The pump system of claim 9, wherein the at least one ferromagnetic core containing the at least one axially-oriented stator passage is evenly perimetrically distributed about the axis with respect to the plurality of ferromagnetic cores.

11. The pump system of claim 7, wherein:

the electric stator has a number m of phases;

the plurality of impeller fins includes an even number B of impeller fins; and the plurality of perimetrically distributed poles includes a number $N_c$ of poles equal to a number of stator coils, such that $N_c$ is an integer multiple of m times the greatest common divisor of $N_c$ and B.

12. A method of pumping fluid, the method comprising:

energizing field poles of the stator of claim 1 situated in an axial fluid path of a centrifugal pump housing with alternating current; and driving the permanent magnet rotor via axial flux impingement from the energized stator on the at least partially radially extending pole shoe impeller fins, such that the fluid is:

drawn axially through at least one aperture in the stator; and forced centrifugally outward and in a radial flow direction by the fluid impeller fins.

13. The method of claim 12, wherein the at least one aperture is a plurality of apertures in the stator that are perimetrically distributed through ferromagnetic cores of the field poles of the stator.

* * * * *